US009744657B2

(12) United States Patent
Baron et al.

(10) Patent No.: US 9,744,657 B2
(45) Date of Patent: Aug. 29, 2017

(54) ACTIVATION SYSTEM HAVING MULTI-ANGLED ARM AND STALL RELEASE MECHANISM

(71) Applicant: Black & Decker Inc., Newark, DE (US)

(72) Inventors: Michael P. Baron, Phoenix, MD (US); Lee M. Brendel, Bel Air, MD (US)

(73) Assignee: BLACK & DECKER INC., New Britain, CT (US)

( * ) Notice: Subject to any disclaimer, the term of this patent is extended or adjusted under 35 U.S.C. 154(b) by 902 days.

(21) Appl. No.: 13/844,714

(22) Filed: Mar. 15, 2013

(65) Prior Publication Data

US 2014/0097223 A1 Apr. 10, 2014

Related U.S. Application Data

(60) Provisional application No. 61/709,574, filed on Oct. 4, 2012.

(51) Int. Cl.
*B25C 1/06* (2006.01)
*B25C 5/15* (2006.01)

(52) U.S. Cl.
CPC . *B25C 1/06* (2013.01); *B25C 5/15* (2013.01)

(58) Field of Classification Search
CPC .... B25C 1/00; B25C 1/06; B25C 5/00; B25C 5/06; B25C 5/10; B25C 5/15; B27F 7/11
USPC ..... 227/8, 129, 131
See application file for complete search history.

(56) References Cited

U.S. PATENT DOCUMENTS

| | | | | |
|---|---|---|---|---|
| 4,964,558 | A * | 10/1990 | Crutcher | B25C 1/06 173/124 |
| 6,669,072 | B2 * | 12/2003 | Burke | B25C 1/06 173/122 |
| 6,971,567 | B1 | 12/2005 | Cannaliato et al. | |
| 7,204,403 | B2 * | 4/2007 | Kenney | B25C 1/06 227/120 |
| 7,575,141 | B1 * | 8/2009 | Liang | B25C 1/06 173/124 |
| 8,302,833 | B2 * | 11/2012 | Gross | B25C 1/06 227/133 |
| 9,346,158 | B2 * | 5/2016 | Garber | B25C 1/06 |
| 9,399,281 | B2 * | 7/2016 | Brendel | B25C 1/06 |
| 2004/0232194 | A1 | 11/2004 | Pedicini et al. | |
| 2007/0102471 | A1 * | 5/2007 | Gross | B25C 1/06 227/131 |
| 2008/0087705 | A1 * | 4/2008 | Wolf | B25C 1/06 227/139 |

(Continued)

*Primary Examiner* — Andrew M Tecco
(74) *Attorney, Agent, or Firm* — Rhonda L. Barton

(57) ABSTRACT

A power tool including an activation arm assembly having an actuator coupled to the activation arm assembly, the activation arm assembly being coupled to the structure and including a roller assembly having a roller, wherein actuation of the actuator causes the roller assembly to translate toward and engage the driver to initiate driving engagement between the driver and the flywheel; The activation arm assembly further includes a follower arm that engages the roller, the follower arm including a first mounting portion and a second mounting portion, the second mounting portion being pivotally coupled to the actuator and slidingly engaged with the carriage, the first mounting portion being biased in a direction toward the driver. The follower arm has a non-linear profile.

11 Claims, 9 Drawing Sheets

(56) References Cited

U.S. PATENT DOCUMENTS

| | | | | |
|---|---|---|---|---|
| 2009/0032567 | A1* | 2/2009 | Liang | B25C 1/06<br>227/131 |
| 2009/0250500 | A1* | 10/2009 | Brendel | B25C 5/15<br>227/132 |
| 2009/0294505 | A1* | 12/2009 | Kunz | B25C 1/06<br>227/8 |

* cited by examiner

ACTIVATION SYSTEM HAVING MULTI-ANGLED ARM AND STALL RELEASE MECHANISM

The present application claims priority under 35 U.S.C. §119 to U.S. Provisional Application Ser. No. 61/709,574 filed on Oct. 4, 2012, which is herein incorporated by reference in its entirety.

BACKGROUND OF THE INVENTION

Field of the Invention

The present invention relates in general to the field of fastening tools and more particularly to a fastening tool with an activation system that has a multi-angled arm and stall release.

Fastening tools, such as power nailers and staplers, are relatively common place in the construction trades. Often times, however, the fastening tools that are available may not provide the user with a desired degree of flexibility and freedom due to the presence of hoses and other attachments that couple the fastening tool to a source of pneumatic power.

Recently, several types of cordless nailers have been introduced to the market in an effort to satisfy the demands of modern consumers. Some of these nailers, however, are relatively large in size and/or weight, which render them relatively cumbersome to work with. Others require relatively expensive fuel cartridges that are not refillable by the user so that when the supply of fuel cartridges has been exhausted, the user must leave the work site to purchase additional fuel cartridges. Yet other cordless nailers are relatively complex in their design and operation so that they are relatively expensive to manufacture and do not operate in a robust manner that reliably sets fasteners into a workpiece in a consistent manner. Accordingly, there remains a need in the art for an improved fastening tool.

SUMMARY OF THE INVENTION

In one embodiment of the present invention, a fastening tool activation system includes a follower arm that provides a non-linear displacement of the assembly in response to a linear actuation of the solenoid. In another embodiment of the present invention, a fastening tool includes a stall release lever to reset the mechanism in the event of a fastener being jammed in the nosepiece or an incomplete drive cycle.

In an embodiment, the power tool comprises a structure, a flywheel coupled to the structure, a driver that is translatable along a driver axis; and an activation arm assembly having an actuator coupled thereto. The activation arm assembly is coupled to the structure and includes a roller assembly having a roller. Actuation of the actuator causes the roller assembly to translate toward and engage the driver to initiate driving engagement between the driver and the flywheel. The activation arm assembly further includes a carriage fixedly coupled to the structure with the actuator being mounted on the carriage. The activation arm assembly further includes a first axle and a second axle. The first axle is received through a pivot slot formed in the carriage and is coupled to the roller assembly. The second axle is coupled to the roller assembly and has the roller mounted thereto. The activation arm assembly further includes a follower arm that engages the roller. The follower arm includes a first mounting portion and a second mounting portion. The second mounting portion is pivotally coupled to the actuator and slidingly engaged with the carriage. The first mounting portion is biased in a direction toward the driver.

In an embodiment, the follower arm has a non-linear profile having a first angle and second angle.

In an embodiment, the first angle is 25 degrees with respect to the upper surface of the follower arm and the second angle is 12 degrees with respect to the upper surface of the follower arm.

In an embodiment, the actuator is received in the carriage.

In an embodiment, the actuator is engaged to the carriage in a snap-fit manner.

In an embodiment, the actuator is a solenoid having a body and a plunger that is being movable along an actuator axis that is generally parallel to the driver axis.

In an embodiment, the carriage includes a pair of arm members, each of the arm members including a pivot slot, a first axle being received through the pivot slot.

In an embodiment, the roller is rotated about the second axle in a direction toward a first portion of the activation arm when the roller initially contacts the driver to drive the driver into driving engagement with the flywheel Further areas of applicability will become apparent from the description provided herein. It should be understood that the description and specific examples in this summary are intended for purposes of illustration only and are not intended to limit the scope of the present disclosure, its application and/or uses in any way.

DESCRIPTION

Figure 1:
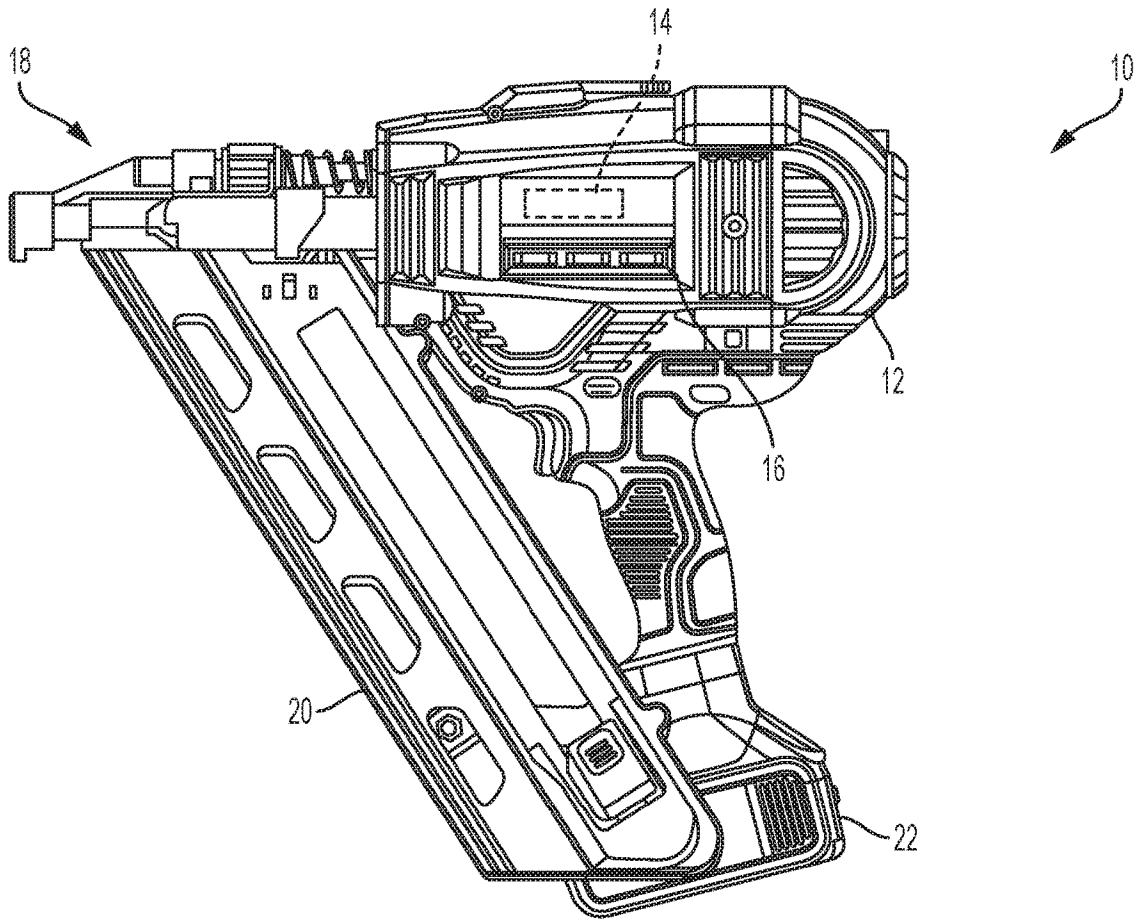
FIG. 1 illustrates a side elevation view of an embodiment of the tool of the present invention.

The following description is merely exemplary in nature and is in no way intended to limit the present teachings, application, or uses. Throughout this specification, like reference numerals will be used to refer to like elements.

Referring now more particularly to the drawings, FIG. 1 illustrates a fastening tool constructed in accordance with the teachings of the present invention.

Figure 2:
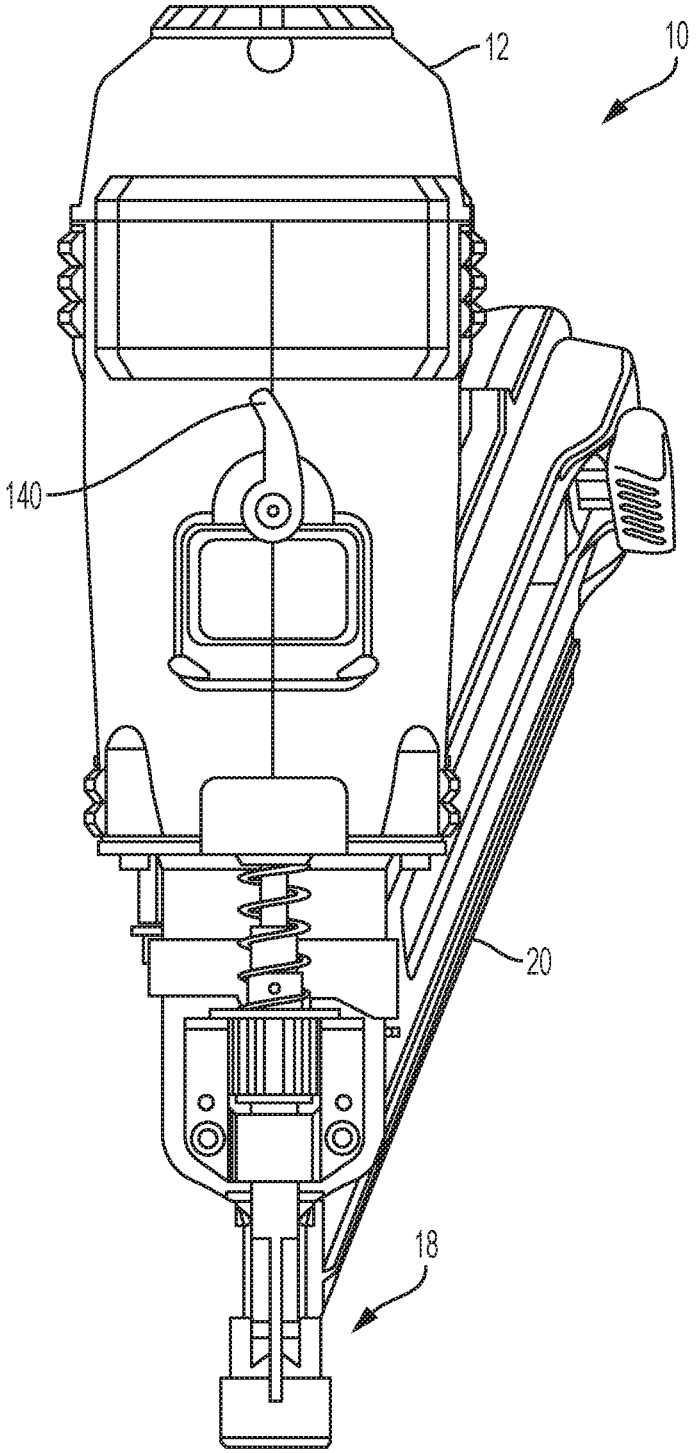
FIG. 2 illustrates a top view of an embodiment of the tool of the present invention.

With reference to FIGS. 1-2, a fastening tool 10 can include a housing assembly 12, a control unit 14, a drive motor assembly 16, a nosepiece assembly 18, a magazine assembly 20 and a battery pack 22. The housing assembly 12, the control unit 14, the nosepiece assembly 18, the magazine assembly 20 and the battery pack 22 can be constructed and operated to drive a fastener, such as a nail. While the fastening tool is illustrated as being electrically powered by a suitable power source or energy storage device, such as the battery pack, those skilled in the art will appreciate that the invention, in its broader aspects, may be constructed somewhat differently and that aspects of the present invention may have applicability to pneumatically powered fastening tools. Furthermore, while aspects of the present invention are described herein and illustrated in the accompanying drawings in the context of a nailer, those of ordinary skill in the art will appreciate that the invention, in its broadest aspects, has further applicability. For example, the drive motor assembly may also be employed in various other mechanisms that use reciprocating motion, including rotary hammers, hole forming tools, such as punches, and riveting tools, such as those that install deformation rivets.

Figure 3:
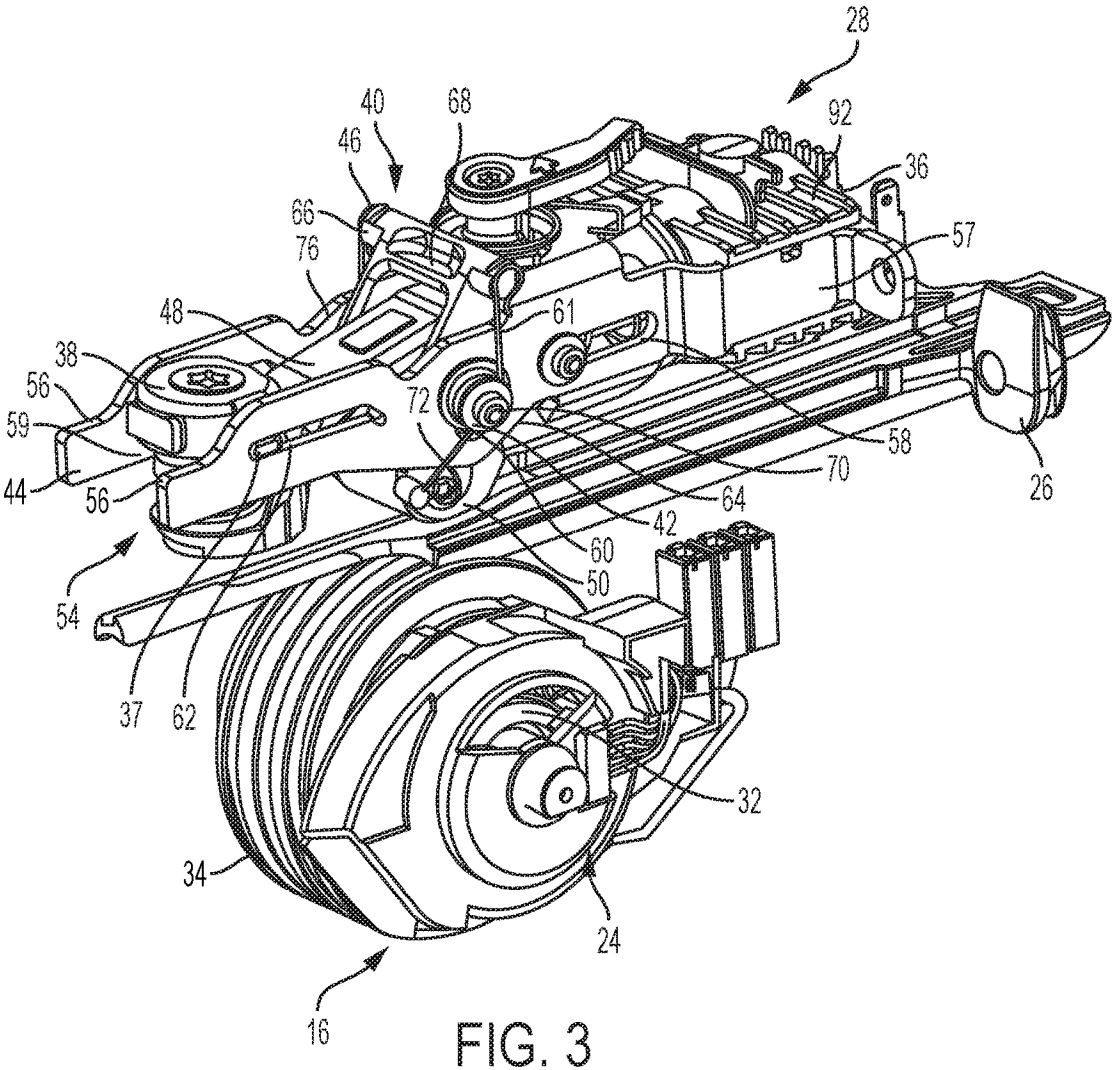
FIG. 3 is an isometric view of the activation system, stall release, and flywheel.
Figure 4:
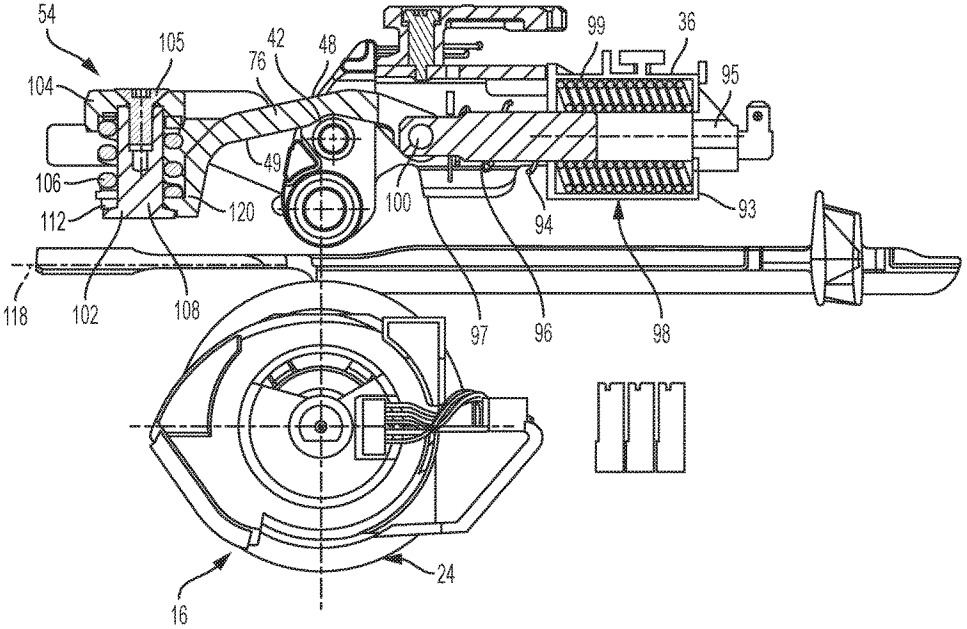
FIG. 4 illustrates the operation of the activation system and flywheel.
Figure 8:
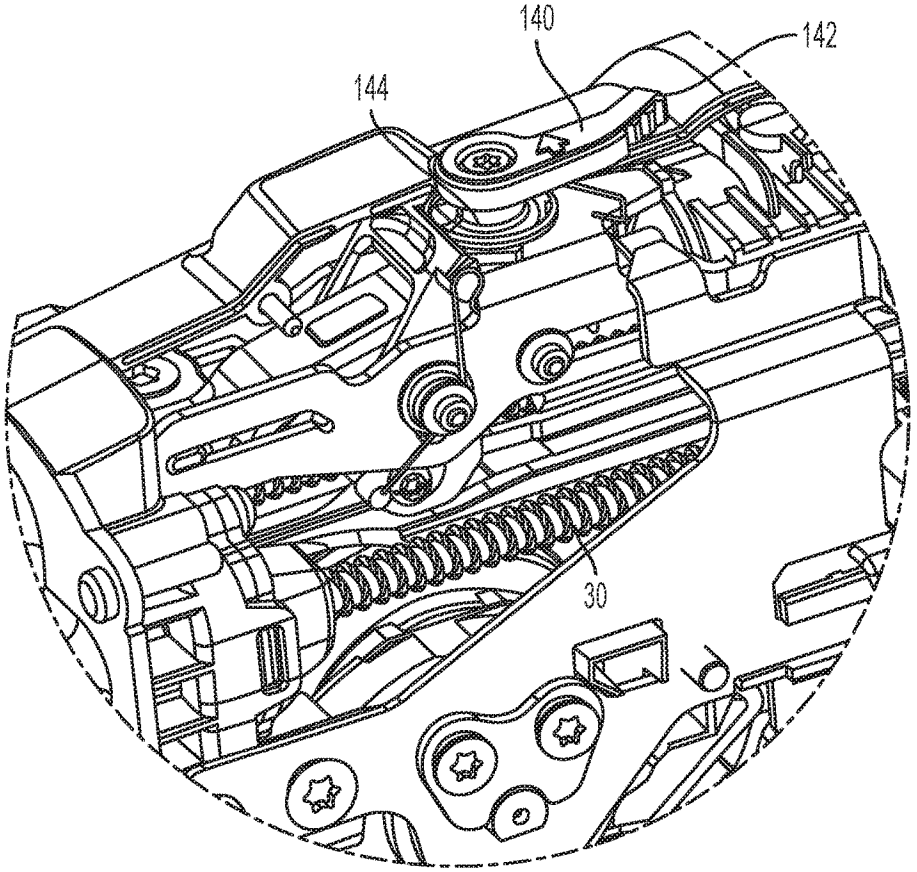
FIG. 8 illustrates a stall release mechanism in the home position.
Figure 9:
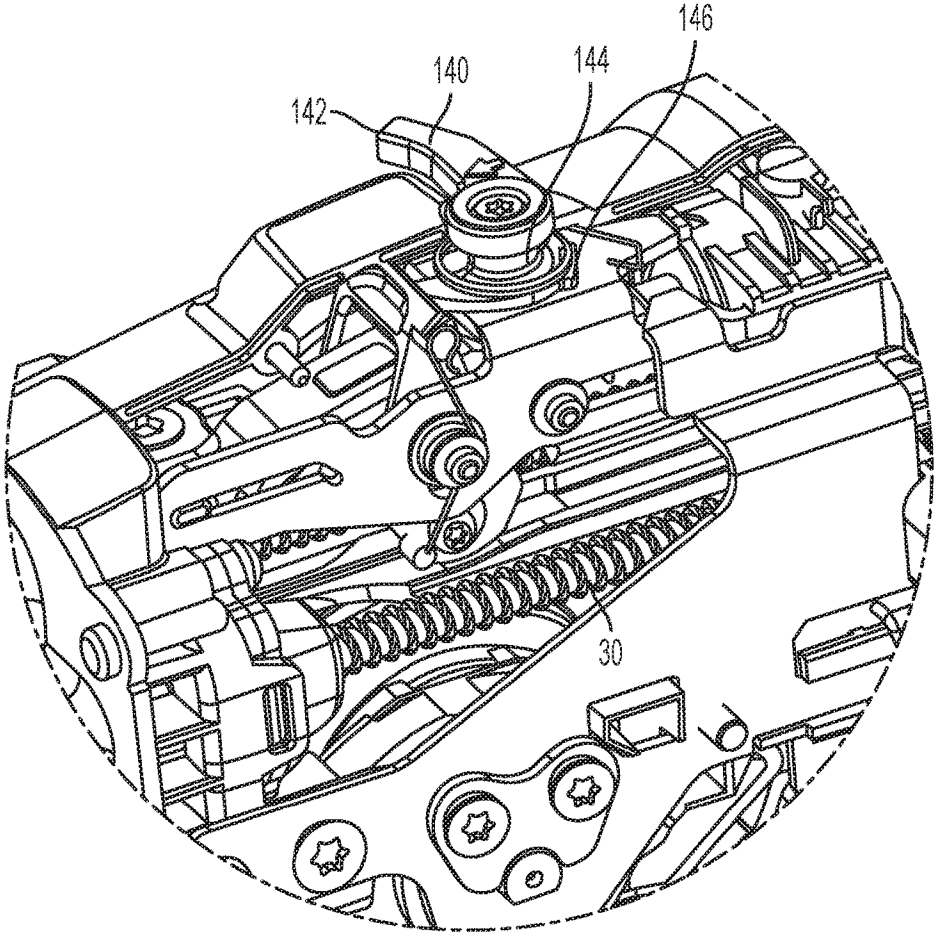
FIG. 9 illustrates a stall release mechanism in the actuated or release position.

The drive motor assembly 16, as shown in FIGS. 3 and 4, may be of any desired configuration, but in the example provided, includes a power source 24, a driver 26, an activation arm assembly 28, and a return mechanism 30 (FIGS. 8 and 9).

In the particular example provided, the power source 24 includes a motor 32, a flywheel 34, and an actuator 36. In operation, fasteners F are stored in the magazine assembly 24, which sequentially feeds the fasteners F into the nosepiece assembly 18. The drive motor assembly 16 may be actuated by the control unit 20 to cause the driver 26 to translate and impact a fastener Fin the nosepiece assembly 18 so that the fastener P may be driven into a workpiece (not shown). Actuation of the power source may utilize electrical energy from the battery pack 22 to operate the motor 32 and the actuator 36. The motor 32 is employed to drive the flywheel 24, while the actuator 36 is employed to move a roller 50 that is associated with the roller assembly 40, which squeezes the driver 26 into engagement with the flywheel 34 so that energy may be transferred from the flywheel 34 to the driver 26 to cause the driver to translate. The nosepiece assembly 18 guides the fastener F as it is being driven into the workpiece. The return mechanism 30 biases the driver 26 into a returned position.

The activation arm assembly 28 can include the actuator 36, a carriage 44, a roller assembly carrier 46, a follower arm 48, a first roller 42, a second roller 50 and a biasing mechanism 54.

FIG. 3 is an isometric view of the activation system and flywheel. As shown, the carriage 44 can include a pair of arm members 56 that can be spaced laterally apart. Each arm member 56 can include an actuator slot 58, a pivot slot 60, a retainer aperture 62 and a notch 64. The arm members 56 can be configured to define a first portion 57, which can be configured to retain the actuator 36, and a second portion 59 which can be configured to retain the biasing mechanism 54. The carriage 44 can be fixedly but removably coupled to the backbone via a tab 37 on each side of the spring cap 38. The tab 37 can be received through the retainer aperture 62.

The roller assembly carrier 46 can include a release bar 66, a first axle 70 and a second axle 72. The release bar 66 can be arranged laterally between first and second arms 56 of the carriage 44. The first axle 70 can extend through the carriage 44 and can be received in the pivot slots 60 in the arm members 56 of the carriage 44. Accordingly, it will be appreciated that the roller assembly carrier 46 can be coupled to the first arm of the carriage 44 for rotation about the first axle 70 and that the roller assembly carrier 46 can move relative to the carriage 44 in a direction that can be dictated by the shape of the pivot slots 60. The first roller 42 can be rotatably mounted on the first axle 70. The second axle 72 can extend through the arm members 56 and a second roller 50 can be rotatably mounted on the second axle 72. The notch 64 in the arm members 56 of the carriage 44 are provided to permit the roller assembly carrier 46 to be able to rotate between a predetermined first position and a predetermined second position. A torsion spring 61 can be mounted to the carriage 44 and roller assembly carrier 46 to bias the roller assembly carrier 46 toward the first predetermined position. The torsion spring 61 can have a coiled body that can be mounted on the first axle 70, a first leg that can engage the roller assembly carrier 46, and a second leg that can engage a hole (not shown) in the carriage 44. It will be appreciated that although the torsion spring 61 has been illustrated on one side of the carriage 44 it could be positioned in the alternative on the opposite side of the carriage 44 if desired. In the particular example provided, the centerline of the second axle 72 is relatively closer to the retainer aperture 62 than the centerline of the first axle 70 when the roller assembly carrier 46 is in the first predetermined position.

The follower arm 48 can include a central arm member 76 and a pair of tab members 78 that can be disposed on opposite lateral sides of the central arm member 76. The central arm member 76 can include a first portion 80, which can be located at an end of the central arm member 76 opposite the tab members 78, a first intermediate portion 82, a second intermediate portion 84, and a second portion 86. A hole can be formed through the first portion 80. The first and second intermediate portions 82 and 84 can cooperate to couple the first portion 80 to the second portion 86. In the example provided, each of the first and second intermediate portions 82 and 84 include an embossed portion 88 that can help to stiffen and reinforce the portion of the central arm member 76 that couples the first and second portions 80 and 86 to one another. The second portion 86 can be received between the first roller 42 and the central member 68 of the roller assembly carrier 46, An aperture 90 can be formed through each of the tab members 78.

The actuator 36 can be an appropriate type of linear actuator. In the example provided, the actuator 36 is a solenoid 92 that includes a body 93, a plunger 94, which is movable relative to the body 93 along an actuation axis 95, and a plunger spring 96 that biases the plunger 94 into an extended position. While the plunger spring 96 is illustrated as being received in the body 93, it will be appreciated that in the alternative the plunger spring 96 can be received about the plunger 94 between a feature on the plunger 94 and the plunger body 93 or between a feature on the plunger 94 and one of the laterally extending arm members 97. The body 93 can include a housing 98 and a coil assembly 99 that can be electrically coupled to the control unit 20. The housing 98 can include a plurality of first projections and a pair of second projections. The first projections can engage and cradle the arm members 56 of the carriage 44 to inhibit movement in directions orthogonal to the actuation axis 95. Each of the second projections can engage an abutting wall that can be formed in a respective one of the arm members 56 of the carriage 44. Contact between the second projections and the abutting walls can inhibit movement of the body 93 relative to the carriage 44 in a first direction (e.g., to the right) and can fixedly couple the body 93 to the carriage 44 in a snap-fit manner. The housing 98 can be sized to engage the arm members 56 at the transition between the first and second portions 57 and 59; abutment of the housing 98 against the arm members 56 limits movement of the body 93 relative to the arm members 56 when the coil assembly 99 is energized and the plunger 94 is being drawn into the body 93 (i.e., abutment of the housing 98 against the arm members 56 limits movement of the housing 98 relative to the carriage 44 in a second direction opposite the first direction). The plunger 94 can include a through-hole that can be aligned to the apertures in the tab members and the actuator slots 58 in the arm members 56. A pin 100 may be received in the through-hole, the apertures and the actuator slots 58. The pin 100 can pivotally couple the follower arm 48 and the plunger 94; the actuator slots 58, which can be disposed generally parallel to the actuation axis 95, can guide and support the end of the plunger 94 to which the follower arm 48 is coupled.

FIG. 4 illustrates the operation of the activation system and flywheel.

Figure 5:
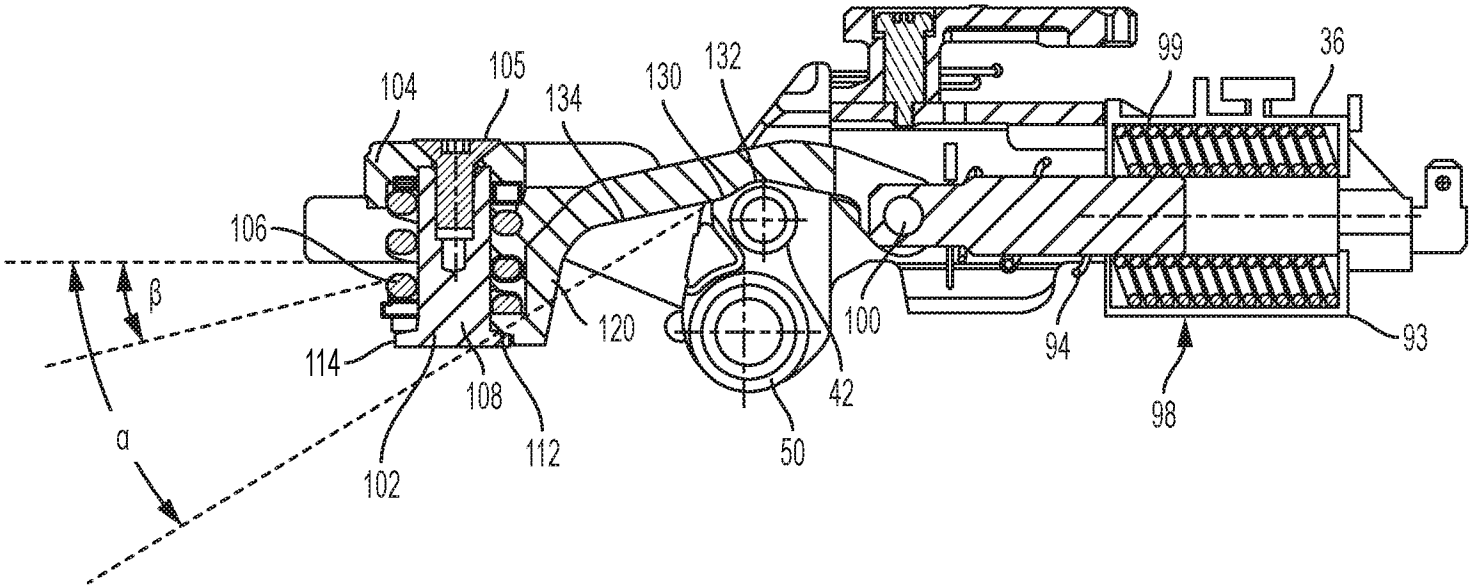
FIG. 5 illustrates an activation system.

FIG. 5 illustrates a follower arm.

As shown in FIGS. 4 and 5, the biasing mechanism 54 can include a first cap 102, a second cap 104, a fastener 105 and a spring 106. The first cap 102 can have a generally cylindrical body member 108 and a flange 114 that can be disposed about the body member 108. The body member 108 can include an internally threaded aperture and can be received in the hole 112 in the first portion 80 of the follower arm 48. The flange 114 can abut a side of the first portion 80 of the follower arm 48.

The second cap 104 can include a hub portion and a wall member that can extend about a portion of the hub portion and can define an opening. The opening can be employed in the assembly of the tool 10 (e.g., to receive the spring and the body member 108 of the first cap 102 there through) and/or can provide clearance between the second cap 104 and the follower arm 48 to permit the follower arm 48 to move as will be described in more detail, below. A pair of tabs or trunnions 37 can be coupled to the opposite sides of the second cap 104 and can be received in the retainer apertures 62 in the arm members 56 of the carriage 44. In the example provided, the retainer apertures 62 are slots that are oriented generally parallel to the actuation axis 95. The retainer apertures 62 can cooperate with the trunnions 37 to limit movement of the second cap 104 along a spring axis.

The spring 106 can be disposed over the body member 108 between the first portion 80 of the follower arm 48 and the hub portion of the second cap 104. The fastener 105 can be employed to secure the second cap 104 to the first cap 102 and optionally to pre-load the spring 106. In the particular example provided, the fastener 105 is threadably engaged to the internally threaded aperture in the body member of the first cap 102.

Figure 6:
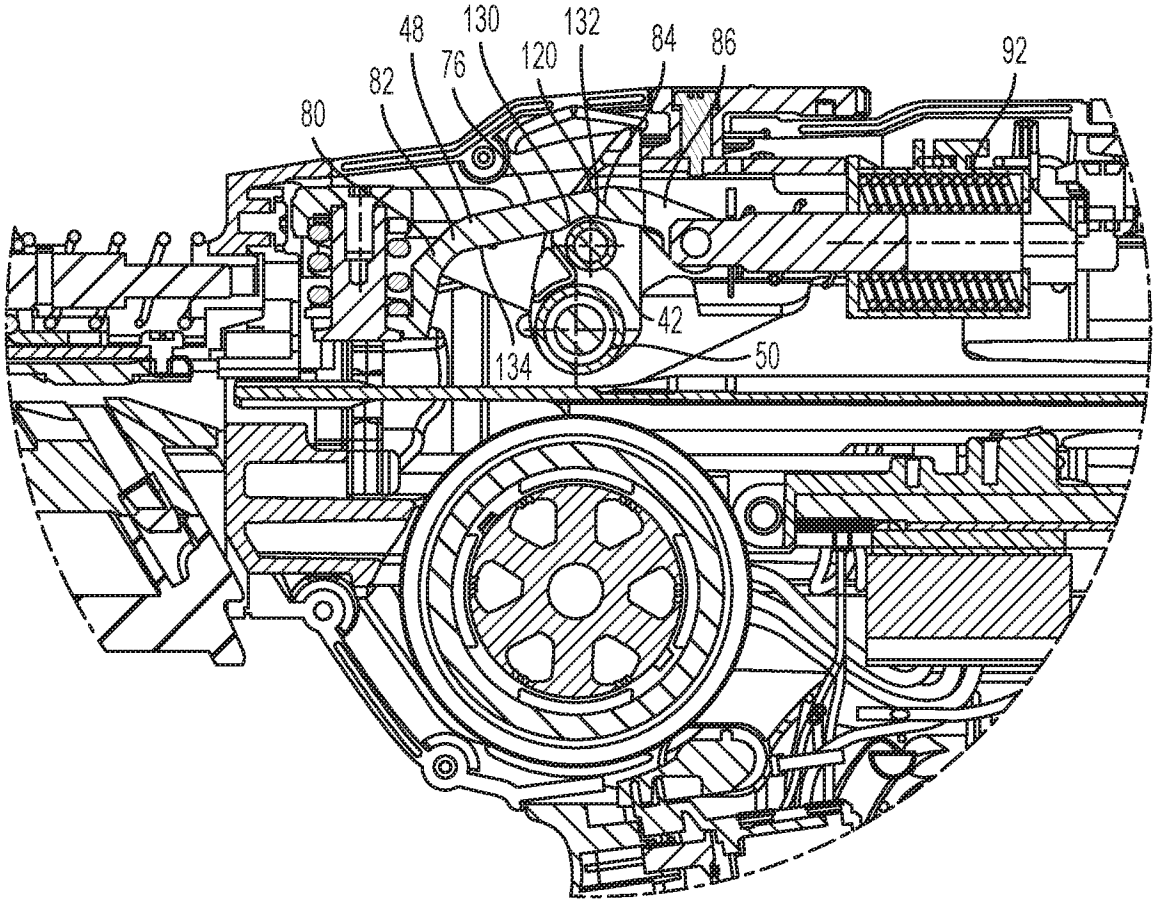
FIG. 6 illustrates a follower arm in a home position and arm angles on the follower arm.

FIG. 6 illustrates the tool 10 in a state prior to activation of the solenoid 92. It will be appreciated that the plunger 94 of the solenoid 92 is located in an extended position (i.e., to the left in the figure) and the second portion 120 of the follower arm 48 is biased about the first roller 42 in a counter-clockwise direction by the spring 106. Accordingly, the second portion 120 of the follower arm 48 can contact the central member 68 of the roller assembly carrier 46 and urge the roller assembly carrier 46 upwardly (as viewed in the figure) in a direction away from the flywheel 34 and the driver 26.

Figure 7:
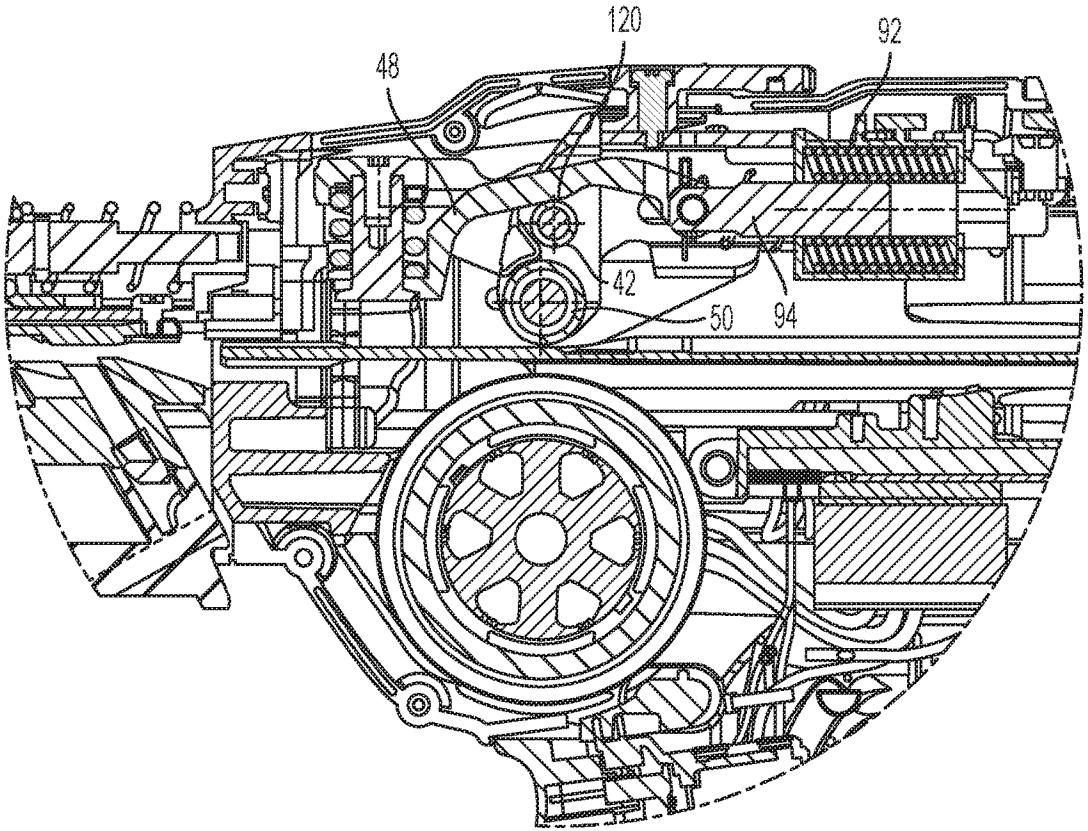
FIG. 7 illustrates a follower arm in an actuated position.

FIG. 7 illustrates the tool 10 in a condition in which the solenoid 92 has been activated and the plunger 94 is being pulled in a second direction into the body 93. Movement of the plunger 94 in the second direction can pull the follower arm 48 toward the body 93, which can cause the second portion 120 of the follower arm 48 to act as a wedge against the first roller 42 to drive the roller assembly carrier 46 toward the driver 26 (downwardly as viewed in the figure). The torsion spring 61 can maintain the roller assembly carrier 46 in the first predetermined position. The side of the notch 64 against which the second axle 72 is engaged can extend generally orthogonal to the axis along which the driver 26 is translated (driver axis 118) and the rotational axis of the flywheel 34. Contact between the second roller 50 and a first cam portion of the driver 26 can drive the driver 26 into driving engagement with the flywheel 34 wherein energy is transmitted limn the flywheel 34 to the driver 26 to translate the driver 26 along the driver axis. It will be appreciated that the notches 64 can be configured such that the centerline of the second axle 72 is relatively closer to the first mount aperture than the centerline of the first axle 70 to thereby maintain the second roller 50 in an over-center position.

FIG. 6 illustrates the tool 10 in a condition in which the second roller 50 has disengaged the driver 26. The second cam 562' on the driver 26 permits the second roller 50 (and thereby the roller assembly carrier 46) to move toward the flywheel 34 to thereby unload the spring 106. Although the torsion spring 61 can bias the roller assembly carrier 46 toward the first predetermined position, there may be insufficient clearance between the driver 26 and the second roller 50 to permit the roller assembly carrier 46 to rotate. Additionally, contact between the driver 26 and the second roller 50 when the driver 26 is being returned may tend to rotate the roller assembly carrier 46 into or toward the second predetermined position. It will be appreciated that the return mechanism 30 can be employed to return the driver 26 to the starting position.

When the driver 26 has been returned, the solenoid 92 can be de-activated to permit the plunger spring 96 to move the plunger 94 to move toward the roller assembly carrier 46. Movement of the plunger 94 in this manner can cause the follower arm 48 to translate toward a first mount aperture. As the second portion 86 of the follower arm 48 is sloped in shape, the second portion 86 can act as a wedge as it contacts the central member of the roller assembly carrier 46 to cause the roller assembly carrier 46 to travel away from the driver 26. Simultaneously, the biasing force that is applied by torsion spring 61 can cause the roller assembly carrier 46 to rotate to the first predetermined position when there is sufficient clearance between the second roller 50 and the driver 26 to thereby return the tool 10 to the condition illustrated in FIG. 6. FIG. 2 illustrates a top view of the fastening tool having a stall release lever.

Additionally, the follower arm 48 transfers the force and displacement of the solenoid plunger 94 in a direction orthogonal to the axis of the solenoid. Additionally, the follower arm profile creates a mechanical advantage for pushing the roller assembly 40 against the profile driver to lock the driver against the flywheel and the activation assembly when the roller assembly 40 is in the actuated position. When the follower arm is in the home position, the roller assembly 40 carriage is biased by a torsion spring in a direction toward the follower arm profile. Also, a clearance exists between the roller assembly 40 and the driver to allow the driver to return to a home position, without obstruction, after driving a fastener. The roller assembly 40 is contained in. a roller assembly carrier 46 that is pivotally connected to the first and second activation arm mounts. The follower arm 48, as shown for example, in FIG. 5, has a non-linear profile. The follower arm 48 contacts the roller assembly carrier 46 along a rotatable sleeve portion of the pivot pin and pushes or displaces the roller assembly 40 in a direction toward the driver 26. The profile 49 of the follower arm 48 allows for maximum roller assembly 40 travel given a limited solenoid displacement and force. This is accomplished by having the roller assembly 40 travel a steep 25 degree angle (alpha) to reduce the clearance between the roller assembly 40 and follower arm profile 49 to allow the driver to return to a home position without obstruction, and to position the roller assembly 40, via the roller assembly carrier 46 to a close proximity, such as, for example, about 0.5 mm, to the profile. The follower arm profile 49 then travels to position its 12 degree portion (beta) over the roller assembly 40 sleeve to provide a mechanical advantage that pushes the driver 26 into the flywheel to initiate a drive sequence, and locking the solenoid plunger 94 and the follower arm 48 in position when contact is made with the driver 26 to initiate the drive cycle. The roller assembly 40 having a vertical displacement reduces the stroke length required by the solenoid plunger 94.

Referring to FIG. 5, one end of the follower arm 48 has a first surface 130 that has a recess portion 132 forming an angle with respect to the axis A of the solenoid and a second surface 134 that is angled with respect to the axis A of the solenoid. In one embodiment, the recess portion angle (alpha) can range from 20-30 degrees, for example, 25 degrees, and also for example, 20, 21, 22, 23, 24, 26, 27, 28 or 29 degrees. The second surface angle (beta) can range from 10-15 degrees with respect to the axis A of the solenoid, and for example, 12 degrees and also for example, 11, 13, or 14 degrees. The angle can be determined by the coefficient of friction required for the roller assembly 40 and follower arm 48 when positioned by the solenoid plunger 94 to lock against the driver and rotating flywheel. The first surface angle being greater than the second surface angle allows for the solenoid plunger 94 to have a smaller displacement than without the first surface angle. The smaller displacement results in less energy being used by the solenoid and, therefore, the control with a smaller, lower force solenoid, resulting in a more compact tool. Additionally, since the activation system is self-locking, the solenoid can provide the initial lock-up approximately 0.030 seconds. This allows for high current to be used thus conserving energy and thermal loading and providing a force to move the components as required. An opposite end of the follower arm 48 can have an angle of about 25 degrees with respect to the axis of the solenoid. An angle that is about 25 degrees eliminates the clearances required for unencumbered driver return after the fastener is driven, thus bringing the roller assembly 40 into contact with the profile 94.

As shown in FIG. 6, the follower arm 48 and roller assembly 40 are in their respective home positions. The roller assembly 40 is spaced apart from the profile 94 to allow the driver to return to the home position after driving the fastener. When the follower arm 48 and the roller assembly 40 are in their home positions, the solenoid is not actuated and a spring is used to bias the roller assembly 40 away from the flywheel and profile 94. A first arm angle that is greater than a second arm angle positions the roller assembly 40 in close proximity to the driver with minimal solenoid displacement.

As shown in FIG. 7, the follower arm 48 and roller assembly 40 are in their respective actuated positions. The follower arm 48 has been displaced by the actuated solenoid and moves the roller assembly carrier 46 and roller assembly 40 downward to wedge against the profile 94. In turn, the profile 94 is forced to wedge against the rotating flywheel. A second arm angle is used in this position for self-locking the roller assembly 40 to provide a contact force needed to drive the profile 94.

The present invention has a number of advantages including but not limited to increasing roller assembly 40 travel that allows for: greater clearance between roller assembly 40 and profile 94 during profile return; and accommodation of the wear on the profile 94 due to the increased travel of the roller assembly 40 caused by the two-arm surface of the follower arm profile 49.

As shown in FIGS. 8 and 9, the stall release lever 140 is a rotatable member that can be mounted on the first and second activation arm mounts. The stall release lever 140 extends outside of an outer surface of the housing 12 as shown in FIG. 2. The stall release lever 140 includes a lever arm 142, a spool 144, and a flange 146. The flange is disposed arcuately around a portion of the base of the spool and has an extended finger. The spool and the flange rotate with the lever arm. The stall release lever can be activated by a user when the drive cycle in not completed such as when attempting to drive a nail into a hard material and insufficient power is available to fully sink the nail. This is referred to as a Stall condition. Additionally it is possible for the tool drive cycle to be incomplete due to operational anomalies such as improper nail loading, non-conforming nails being used, or worn or broken components in the tool. This is referred to as a jam. In operation, when a stall or jam occurs, the user can rotate the lever arm in a counter clockwise direction to release the load on the activation system. Movement of the lever arm rotates the spool and the flange. The extended finger of the flange is configured to push against the upper portion of the roller assembly carrier 46, pivoting the roller assembly 40 away from the profile in order to release the loading force against the profile. Thus, the components in the tool are able to return to their respective home positions.

FIG. 9 illustrates the flange of the stall release lever contacting the upper portion of the roller assembly carrier 46.

While aspects of the present invention are described herein and illustrated in the accompanying drawings in the context of a fastening tool, those of ordinary skill in the art will appreciate that the invention, in its broadest aspects, has further applicability.

It will be appreciated that the above description is merely exemplary in nature and is not intended to limit the present disclosure, its application or uses. While specific examples have been described in the specification and illustrated in the drawings, it will be understood by those of ordinary skill in the art that various changes may be made and equivalents may be substituted for elements thereof without departing from the scope of the present disclosure as defined in the claims. Furthermore, the mixing and matching of features, elements and/or functions between various examples is expressly contemplated herein, even if not specifically shown or described, so that one of ordinary skill in the art would appreciate from this disclosure that features, elements and/or functions of one example may be incorporated into another example as appropriate, unless described otherwise, above. Moreover, many modifications may be made to adapt a particular situation or material to the teachings of the present disclosure without departing from the essential scope thereof. Therefore, it is intended that the present disclosure not be limited to the particular examples illustrated by the drawings and described in the specification as the best mode presently contemplated for carrying out the teachings of the present disclosure, but that the scope of the present disclosure will include any embodiments falling within the foregoing description and the appended claims.

We claim:

1. A power tool comprising:

a structure;

a flywheel coupled to the structure;

a driver that is translatable along a driver axis; and an activation arm assembly having an actuator having an actuation axis generally parallel to the driver axis, the actuator being coupled to the activation arm assembly, the activation arm assembly being coupled to the structure and including a roller assembly having a first roller and a second roller, wherein actuation of the actuator causes the roller assembly to translate toward and engage the driver to initiate driving engagement between the driver and the flywheel, wherein the activation arm assembly further includes a carriage, the carriage being fixedly coupled to the structure, the actuator being mounted on the carriage, wherein the activation arm assembly further includes a first axle and a second axle, the first axle being received through a pivot slot formed in the carriage, the first axle and the second axle being coupled to the roller assembly, the first roller being mounted on the first axle and the second roller being mounted on the second axle, wherein the activation arm assembly further includes a follower arm that engages the first roller, the follower arm including a first mounting portion and a second mounting portion, the second mounting portion being pivotally coupled to the actuator and slidingly engaged with the carriage, the first mounting portion being biased in a direction toward the driver, and wherein the follower arm has a non-linear profile including:

a first surface having a linear plane and having a recess offset from the linear plane, in which the first roller engages the follower arm, the recess defining a first angle with respect to the actuation axis, and a second surface defining a second angle with respect to the actuation axis.

2. The power tool according to claim 1, wherein the first angle is 25 degrees with respect to the actuation axis and the second angle is 12 degrees with respect to the actuation axis.

3. The power tool according to claim 1, wherein the actuator is received in the carriage.

4. The power tool according to claim 1, wherein the actuator is engaged to the carriage in a snap-fit manner.

5. The power tool according to claim 1, wherein the actuator is a solenoid having a body and a plunger, the plunger being movable along the actuation axis.

6. The power tool according to claim 1, wherein the carriage includes a pair of arm members, each of the arm members including the pivot slot through which the first axle is received.

7. The power tool according to claim 1, wherein the first roller is rotated about the first axle in a direction toward the first mounting portion of the follower arm when the second roller initially contacts the driver to drive the driver into driving engagement with the flywheel.

8. A power tool comprising:

a housing;

a structure disposed within the housing;

a flywheel coupled to the structure;

a driver that is translatable along a driver axis;

an activation arm assembly having an actuator coupled to the activation arm assembly, the activation arm assembly being coupled to the structure and including a roller assembly having a roller; and a stall release lever comprising:

a lever arm mounted in a cantilevered manner to the activation arm assembly and extending outside of an outer surface of the housing;

a spool connected to the lever arm and mounted between the lever arm and a body of the activation arm assembly; and a flange disposed around a portion of the spool, wherein and the spool and the flange rotate with the lever arm, and wherein the lever arm rotates about an axis perpendicular to the driver axis.

9. A power tool comprising:

a structure;

a flywheel coupled to the structure;

a driver that is translatable along a driver axis; and an activation arm assembly having an actuator having an actuation axis generally parallel to the driver axis, the actuator being coupled to the activation arm assembly, the activation arm assembly being coupled to the structure and including a roller assembly having a first roller and a second roller, wherein the activation arm assembly further includes a follower arm that engages the first roller, and wherein the follower arm has a non-linear profile including:

a first surface having a linear plane and having a recess offset from the linear plane, in which the first roller engages the follower arm, the recess defining a first angle with respect to the actuation axis, and a second surface defining a second angle with respect to the actuation axis.

10. The power tool according to claim 9, wherein the first angle is 25 degrees with respect to the actuation axis and the second angle is 12 degrees with respect to the actuation axis.

11. The power tool according to claim 9, wherein the actuator is a solenoid.

* * * * *